US006143381A

United States Patent [19]

Hawkins

[11] Patent Number: 6,143,381

[45] Date of Patent: Nov. 7, 2000

[54] BACKLIGHTING APPARATUS FOR A LIGHT TRANSMISSIVE ORNAMENT

[76] Inventor: Victor J. Hawkins, 2462 Wine Country Ave., Napa, Calif. 94558

[21] Appl. No.: 09/158,414

[22] Filed: Sep. 22, 1998

Related U.S. Application Data

[63] Continuation-in-part of application No. 08/877,528, Jun. 17, 1997, abandoned.

[51] Int. Cl.[7] ..... A47G 33/08; A47G 33/10

[52] U.S. Cl. ..... 428/7; 428/99; 362/806

[58] Field of Search ..... 428/7, 99; 362/806; 40/582

[56] References Cited

U.S. PATENT DOCUMENTS 1,553,053 9/1925 Towle ..... 362/806
3,220,130 11/1965 Falkenberg ..... 40/564
5,761,838 6/1998 Chisholm et al. ..... 428/7

*Primary Examiner*—Alexander S. Thomas
*Attorney, Agent, or Firm*—Thomas C. Feix

[57] ABSTRACT

An apparatus for backlighting a stained glass ornament, on a Christmas tree, or the like, is disclosed. A platform is provided with a slotted or "keyhole" opening adapted to slidingly receive the base of a standard Christmas tree light. Attached at one side of the base, and perpendicular thereto, is a focal reflective surface to direct the light of the miniature electric lamp common to such strings of lights toward a decorative light transmissive panel located on the opposite side of the base. In one embodiment described herein, the reflective, or mirror, portion of the apparatus is round or oval: in a second embodiment it is generally rectangular in shape. The slotted opening in the preferred embodiment is of the keyhole type to secure the miniature lamp in the desired position and the device is further equipped with an attachment member to attach the unit to a tree or other object that the user wishes to adorn.

19 Claims, 3 Drawing Sheets

BACKLIGHTING APPARATUS FOR A LIGHT TRANSMISSIVE ORNAMENT

SPECIFICATION

This application is a continuation in part of Ser. No. 08/877,528, filed Jun. 17, 1997, now abandoned.

FIELD OF THE INVENTION

The present invention relates generally to decorative lighting. More specifically, the present invention relates to a backlighting attachment that can be easily connected and disconnected to an existing string of low-wattage lights, commonly hung on Christmas trees, or extended around the windows of houses. Even more specifically, it relates to a backlighting attachment wherein a focal mirror is held in such a manner that it accentuates and enhances the decorative effect of the light.

DESCRIPTION OF THE PRIOR ART

People have been decorating where they live and work during various holidays for centuries. Lights have always been a popular way to attract attention to the holiday and to emphasize the sense of celebration. Lights are hung, especially around Christmas time, on both trees bought for the purpose and occasionally on outdoor shrubbery. Additionally, they are sometimes attached to the house or building around windows, along the eaves, or the like. These lights perforce are of a low wattage type and typically have a limited sight area due to the relatively few lumens that they produce. The present invention seeks to address this defect by providing a fixed focal mirror that directs the light output of the bulb onto a light transmissive area, thus enhancing the decorative effect. During a search at the United States Patent and Trademark Office, a number of patents were uncovered that are relevant, and they are discussed hereinbelow:

U.S. Pat. No. 3,749,903 issued on Jul. 31, 1973 to Paul Belokin, Jr. describes a psychedelic reflection device wherein a colored diaphragm or disc is held in relation to a transparent dome to transmit light and form a reflected pattern. Unlike the present invention, there is no teaching of the fixed focal mirror and the placement of the light source between it and the translucent decorative area, nor is there the teaching of the attachment means to an existing light cord.

In U.S. Pat. No. 3,463,918 issued on Aug. 26, 1969 to Charles Franc there is disclosed an illuminated ornament. In this invention, the lamp is held within an enclosure and a cover, including a light transmissive surface, surrounds it. This is clearly dissimilar from the present invention in that no teaching of a light concentrating means, such as a focal mirror, is taught.

Next is U.S. Pat. No. 5,199,202 issued on Apr. 6, 1993 to Gary S. Musgrave. This describes a light box having multiple image-forming means. This is accomplished by having a pair of mirrors, one opaque and one transparent, held in a spaced apart relationship such that a viewer will see multiple reflections of a design carried by the opaque mirror when the mirrors are set at an angle to one another by virtue of the grooved inner surface of the light box. This is dissimilar from the present invention in that there is no teaching of the light source being disposed between a mirror and a light transmissive decorative surface.

Another patent of interest is U.S. Pat. No. 4,939,004 issued on Jul. 3, 1990 to Lloyd J. Fuss. This is a Christmas tree ornament wherein a representation of a human head and a pair of hands are adjustably attached to the tree. The ornamental members representing the head and hands are made of a light transmissive material. This is clearly unlike the present invention in that there is no teaching of a light focusing device, such as the focal mirror of the present invention.

In U.S. Pat. No. 3,55,495 issued on Apr. 11, 1972 to Harvey A. Carrell there is disclosed an ornamental artificial Christmas tree. The tree is comprised of an upright post that supports a plurality of cans. Interiorly located within the cans are intermittent lights and colored ornaments depend centrally from the can opening to provide an overall kaleidoscopic effect. This is clearly dissimilar from the present invention in that no light transmissive decorative surface is taught.

Another patent of interest is U.S. Pat. No. 2,769,081 issued on Oct. 30, 1956 to Elizabeth B. Sinutko. This discloses a reflective enclosure for Christmas tree lights. The enclosure is made up of a convoluted spring having light reflective properties. This is unlike the present invention in that no light transmissive panel or surface is taught.

U.S. Pat. No. 2,134,356 issued on Oct. 25, 1938 to Elliot I. Clemence discloses a reflector ornament for light bulbs. The reflector as described in this device is mounted proximate the threaded receiving area for the bulb and the light transmissive portion is equipped with a recessed portion marked at d in FIG. 1 to receive the filament end of the bulb. This is unlike the present invention in that the bulb is in contact, either directly or indirectly, with both the light transmissive portion of the device and the reflector. This configuration has inherent in it the possibility of heating either or both of these constituents to the point of causing a hazard, if not of fire, then of injury, through an inadvertent burn.

In U.S. Pat. No. 1,791,533 issued on Feb. 10, 1931 to Walter B. Parmele there is disclosed a display device wherein the device itself, in its upright supporting member, has the appearance of a Christmas tree and is adapted to receive bulbs in a number of sockets. This is clearly dissimilar from the instant invention, in that no spaced apart focal reflector is taught that directs the light towards a decorative light transmissive panel or ornament.

Next is U.S. Pat. No. 1,553,053 issued on Sep. 8, 1925 to John Towle. This discloses an ornamental electric light where the bulb is held within a frame adapted to secure a wreath or the like. This is unlike the present invention in that, though a reflective surface at the rear of the frame portion of the device is discussed, there is no teaching either of the focal mirror disposed to direct the light towards an ornamental light transmissive panel, or of the attachment means that allows the present invention to be readily attached and detached from an existing string of lights.

Lastly, U.S. Pat. No. Des. 375,453 issued on Nov. 12, 1996 to Jacob Fleck discloses a Christmas light holder. The functionality of this design seems to be directed at a pair of resilient clip members disposed perpendicular to one another; thus, it is clearly unlike the present invention in that no light reflecting or transmitting surface can be seen.

Thus, while the foregoing body of prior art indicates it to be well known to use various devices to enhance the lights attendant to holiday decorations, the present invention does so in a novel and convenient manner. Additionally, the provision of a more simple and cost effective device as provided for in the following description of the instant invention is not contemplated in the art discussed above. Nor does the prior art described above teach or suggest an ornament backlighting device that may be detached and reattached in the simple manner described hereinafter. The foregoing disadvantages inherent in the prior art are overcome by the unique construction of the present invention as will be made apparent from the following description thereof. Other advantages of the present invention over the prior art also will be rendered evident.

SUMMARY OF THE INVENTION

To achieve the foregoing and other advantages, the present invention, briefly described, provides an improved Christmas or holiday ornament apparatus. A platform is provided with a slotted opening adapted to slidingly receive the base of a standard Christmas tree light. Attached at one side of the base, and perpendicular thereto, is a focal reflective surface to direct the light of the miniature electric lamp common to such strings of lights toward a decorative light transmissive panel located on the opposite side of the base. In one embodiment described herein, the reflective, or mirror, portion of the apparatus is round or oval: in a second embodiment it is generally rectangular in shape. The slotted opening in the preferred embodiment is of the keyhole type to secure the miniature lamp in the desired position and the device is further equipped with a hanger means to attach the unit to a tree or other object that the user wishes to adorn.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will form the subject matter of the claims appended hereto.

In this respect, before explaining at least two preferred embodiments of the invention in detail, it is to be understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which this disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved backlighting apparatus for a light transmissive ornament which has all of the advantages of the prior art and none of the disadvantages.

It is an object of the present invention to obviate or mitigate the above disadvantages.

It is another object of the present invention to provide a new an improved backlighting apparatus for a light transmissive ornament that may be easily and efficiently manufactured and marketed.

It is a further objective of the present invention to provide a new and improved backlighting apparatus for a light transmissive ornament that is of durable and reliable construction.

An even further object of the present invention is to provide a new and improved backlighting apparatus for a light transmissive ornament which is susceptible of a low cost of manufacture with regard to both materials and labor, and which accordingly is then susceptible of low prices of sale to the consuming public, thereby making such backlighting is apparatus for a light transmissive ornament available to the buying public.

Still yet a further object of the present invention is to provide a new and improved backlighting apparatus for a light transmissive ornament wherein the device can be readily attached and detached from a standard string of Christmas lights.

It is still a further object of the present invention is to provide a new and improved backlighting apparatus for a light transmissive ornament wherein a light focusing means, such as a shaped mirror, serves to concentrate the light generated by the miniature electric lamp onto a light transmissive surface.

Still a further object of the present invention is to provide a new and improved backlighting apparatus for a light transmissive ornament including means for holding the light, the focusing mirror or reflective surface, and the decorative light transmissive panel, in a predetermined relationship with one another such that a maximum amount of the light emanating from the miniature electric lamp is directed through or onto the decorative panel.

Still yet another object of the invention is to provide a new and improved backlighting apparatus for a light transmissive ornament wherein the device can be easily placed in a desired location on the Christmas tree or other though a hanger, located proximate the decorative panel, so as not to interfere with either the operation of the miniature lamp or the path of the reflected and transmitted light.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawings wherein.

DESCRIPTION OF THE PREFERRED EMBODIMENTS

With reference now to the drawings, a new and improved backlighting apparatus for a light transmissive ornament embodying the principles and concepts of the present invention will be described.

Figure 1:
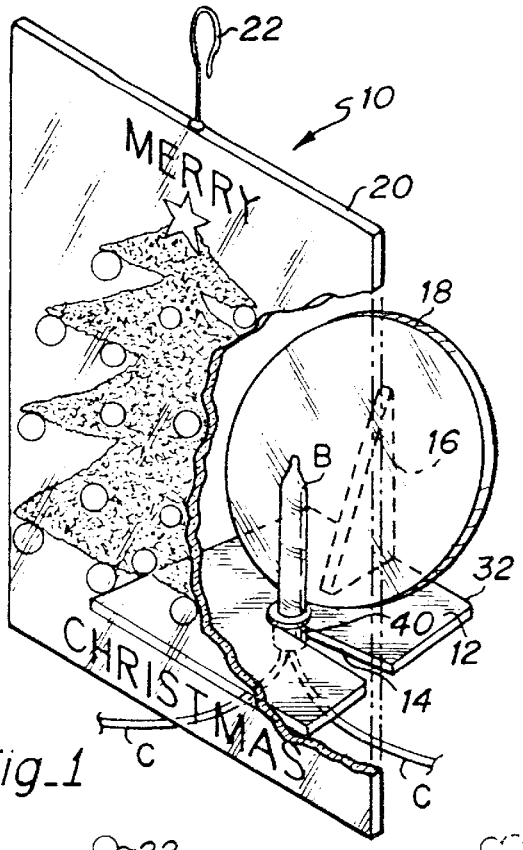
FIG. 1 is a partially cutaway isometric view showing the first preferred embodiment of the new and improved backlighting apparatus for a light transmissive ornament with the reflective surface support shown in dotted lines.

Turning initially to FIG. 1, there is shown a first exemplary embodiment of the invention generally designated by reference numeral 10. In its preferred form, 10 comprises a illuminative source engagement portion or holder portion 12, an illuminative member receiving slot 14, a reflective surface support 16, a reflective surface 18, and a decorative light transmissive panel 20. Located on the light transmissive panel 20 are attachment or suspension means 22 for removably attaching or suspending the device 10 to or from an attachment/suspension point on a branch of a tree or other supporting object, with a simple hanger being preferred. In addition to the hanger-shaped attachment/suspension means 22 described above, the attachment/suspension means may include other types of simple mechanical structure including, but not limited to, Velcro®, magnets, suction cups, alligator clips, buttons or snaps.

The type of light that the present invention is adapted to be used in conjunction with is commonly available. They generally come in strings, with a plurality of low-wattage bulbs (denoted at B in the FIGS.) friction or snap-fit into receptacles (denoted at 40 in the FIGS.) along the length of the light strand C. As will be discussed further below, these fixed bulb receptacles 40 provide an area for the illuminative member receiving slot 14 to engage them. It is not deemed necessary in the course of this description to enlarge any further on the nature of the light strand or the construction thereof, these devices being well known decorative art and commonly available at retail outlets, especially during the holiday season.

The materials from which the present invention can be constructed are numerous, though for reasons of economy and safety, a nonconductive plastic material is contemplated. Of course other materials such as wood, or wood by-products could be used, the overriding consideration governing the choice being a combination of heat resistance and lack of electrical conductivity.

Referring now back to the Figures, the device 10 will be discussed in its first embodiment. First regarding the illuminative source engagement portion or holder portion 12. This is seen to be generally rectangular in shape with a keyhole type slot 14 in it to receive the bulb. The main purpose of the holder portion 12 is to secure the bulb B, and its attendant conductive base 5 in place with regard to the light reflective surface 18 and the light transmissive decorative panel 20. Thus, the holder portion 12 is not limited to the generally rectangular shape shown in the drawings but could be round, elliptical, or even a framework structure, as long as it served its function in predetermining the location of the bulb so that the novel illumination of the instant invention is provided. The holder portion 12 has a decorative panel attachment edge 30 that in this embodiment comprises a straight rim to allow the fixing, either by adhesive or some other means, of the decorative light transmissive panel 20. Opposite the decorative panel attachment edge is the reflective surface support attachment edge 32. Proximate this edge 32 is the reflective surface support 16. In the embodiments described herein, this is represented as a generally right triangular member with the long side supporting the reflective surface 18.

It should be emphasized that other types of support are encompassed in this invention, and that this reflective surface support 16 could be any number of shapes. Additionally, the support 16 could be made to be adjustable to allow the user to direct the reflected light wherever they wish on the decorative light transmissive panel 20. In FIG. 1 the light reflective surface 18 is shown with an oval or circular periphery. As will be discussed in the second embodiment of the invention, that is but one of the configurations contemplated by the present invention. Light reflective surface 18 could be manufactured from a number of various materials, with the concern being that the side proximate the light source B have a sufficient albedo to carry out the decorative purpose of the device 10. Various types of reflective sheeting are known which could be bonded to a plastic surface to achieve the goal contemplated. Mirrors and reflectors are well known in the decorative art and elucidating or reciting a list is not deemed necessary. Knowledgeable practitioners would find at hand any number of methods of accomplishing the reflective aspect of the invention as set forth herein.

Figure 3:
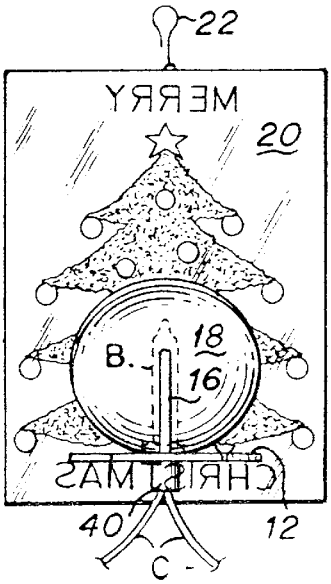
FIG. 3 is a rear view of the first embodiment of the invention.
Figure 2:
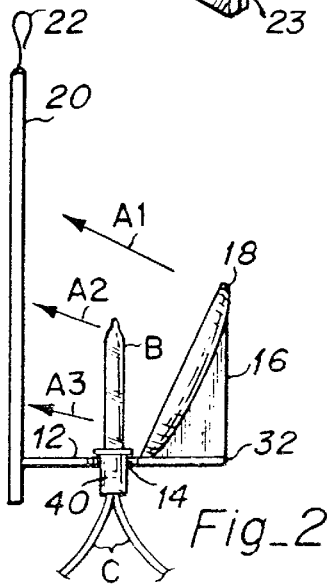
FIG. 2 is a side view of the invention.

Another feature of the present invention, best seen in FIGS. 2 and 3 is the focal nature of the reflective surface 18. As can be seen in both FIGS. 2 and 3, surface 18 is designed to concentrate the light propagated by bulb B and transmit it toward the light transmissive decorative panel 20. This concentration of the propagated light is denoted by the directional arrows A1, A2, and A3 in FIG. 2.

Turning to the light transmissive decorative panel 20, this can be seen, in the illustrative embodiments, to include a picture and/or indicia to convey a greeting or a sense of the season. The panel as contemplated in the instant invention could be either transparent, translucent, or it could be a combination of the two. In a preferred embodiment of the invention, the light transmissive panel comprises a lenticular card. Additionally, the decorative panel 20 could be made to be detachable from the light holding base 12. This attachment and detachment mechanism could be any one of a number of techniques known to a skilled practitioner.

OPERATION

Figure 4:
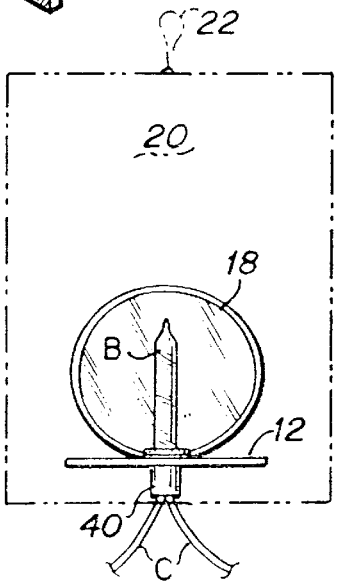
FIG. 4 is a front view of the first embodiment of the present invention with the light transmissive panel element shown in broken lines.
Figure 5:
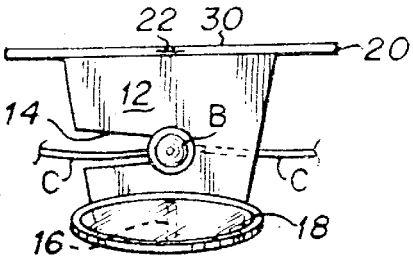
FIG. 5 is a top view of the present invention showing the preferred keyhole type slot for accepting the base of a standard miniature Christmas light string bulb.

When it is to be used, the novel backlighting apparatus for a light transmissive ornament is attached to the existing string of lights. This is accomplished in the preferred embodiments described herein by means of a keyhole type slot 14. Referring to FIG. 5, the best view of the preferred slot is seen. The slot 14, is cut into the support base 12. Slot 14 has a wider opening 34 and narrows, as indicated at 36, until it opens out into a generally circular aperture, denoted at 38. This is what is referred to as a "keyhole" type slot, and the slot 14 as is used in the instant invention is dimensioned and configured to accept the conductive bulb receptacle 40. As mentioned immediately above, these light strings are of a standard type, and the dimensions of the slot 14 in the instant invention would be such that any small variation in size would be accounted for. As can be seen in FIGS. 2, 3, and 4, when the bulb receptacle 40 is in place, electrical cord C is disposed beneath the support base 12 and the bulb B is held between the reflective surface 18 and the decorative light transmissive panel 20. Hanger means 22 can then be used to fix the device 10 and its attendant light fixture to a Christmas tree or the like. When the power is switched on, a pleasing effect is obtained due to the fact that not only is light transmissive panel 20 illuminated directly by light coming from bulb B, but additional illumination is provided by the reflected light directed toward panel 20 by the reflective surface 18.

Alternate Embodiments of the Invention

FIGS. 6–10 disclose several alternate embodiments of the present invention. Structural elements common to both the preferred embodiment of FIGS. 1–5 and the alternate embodiments of FIGS. 6–10 are indicated by the same reference numerals.

Figure 6:
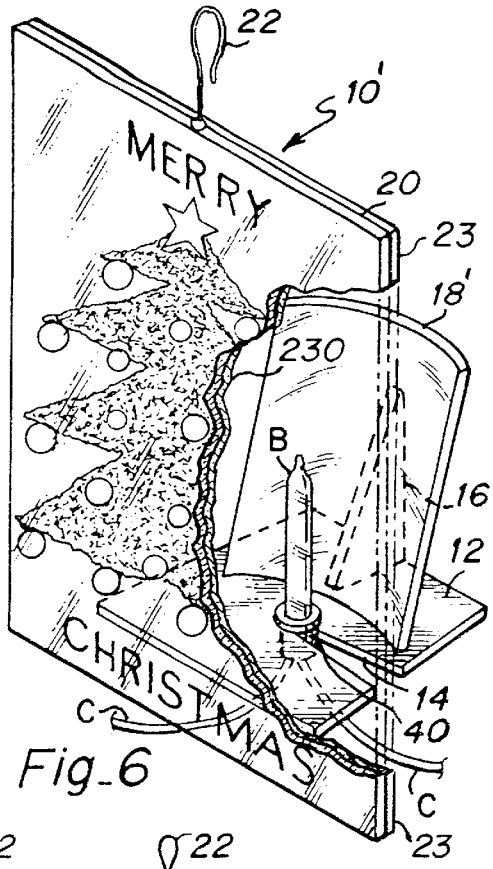
FIG. 6 is partially cut away isometric view of a second embodiment of the invention wherein the focal reflecting surface is generally rectangular in shape.

In FIG. 6 there is shown a second embodiment of the present invention generally designated by reference numeral 10'. In its preferred form, the backlighting apparatus 10' comprises a holder portion 12, an illuminative member receiving slot 14, a reflective surface support 16, a focal reflective surface 18', and a decorative light transmissive panel 20. Located on the light transmissive panel 20 are attachment or suspension means 22, adapted such that the device 10 may be attached to or suspended from a suspension point on a branch of a Christmas tree or other supporting object. It can be seen that the second embodiment of the invention is substantially similar to the first excepting that the focal mirror reflecting surface 18' is parabolic and has a rectangular outline. This provides a broader diffusion of the reflected light over the decorative panel, if the user should so desire. As mentioned above, the decorative panel could easily be made detachable from the holder portion.

Figure 7:
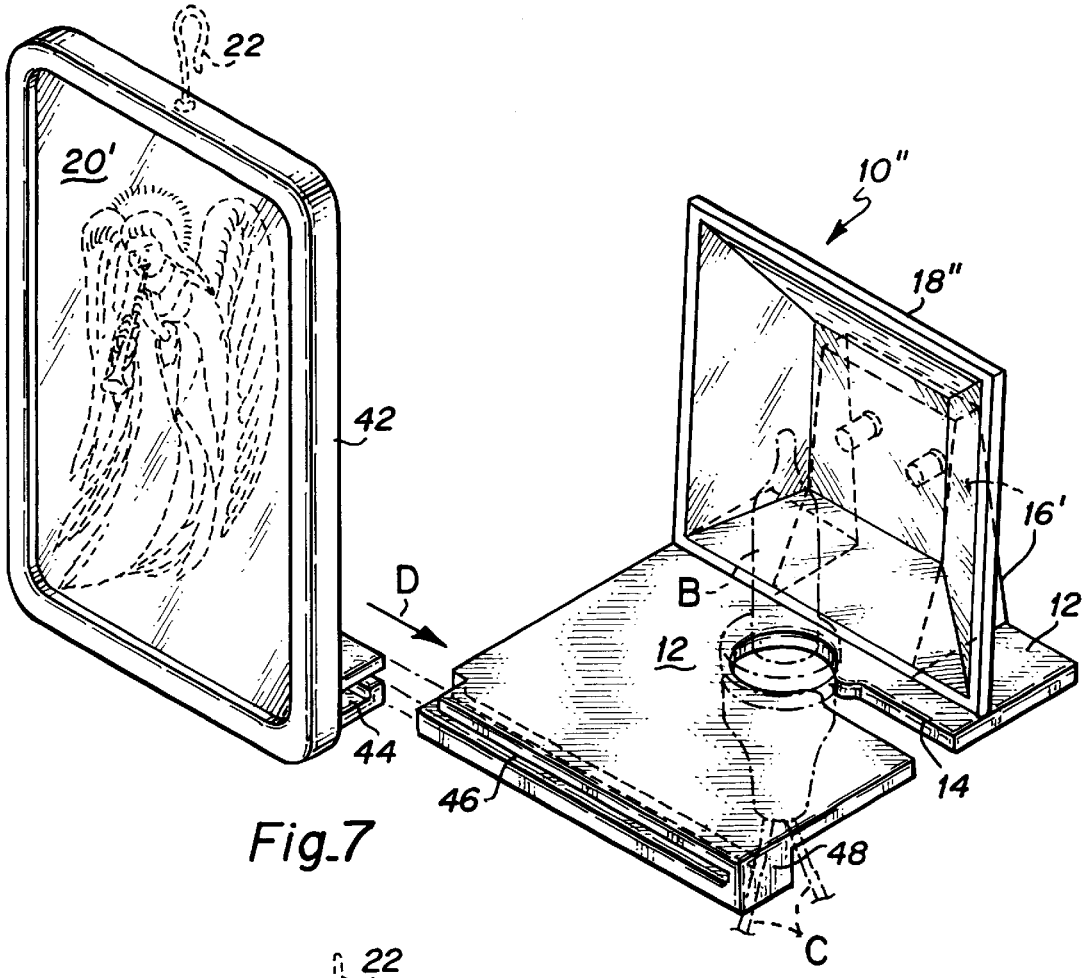
FIG. 7 is a left front isometric view of a second alternate embodiment of the backlighting apparatus of the present invention.
Figure 8:
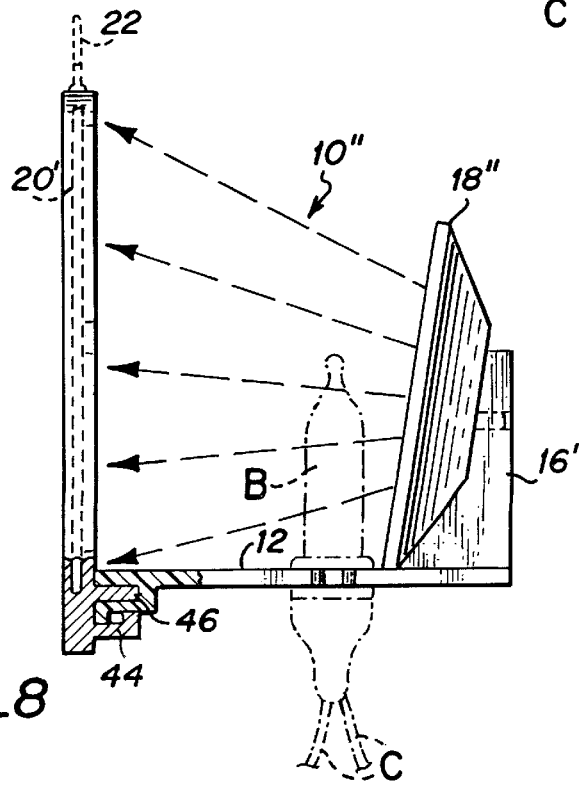
FIG. 8 is a left side elevation view of the second alternate embodiment of FIG. 7 showing the disconnectable connection structure between the light transmissive panel assembly and holder portion in partial cross section.

In FIGS. 7–8, there is shown a third embodiment of the present invention generally designated by reference numeral 10". In its preferred form, the backlighting apparatus 10" comprises a holder portion 12, an illuminative member receiving slot or light bulb retainer 14, a reflective surface support 16', a focal reflective surface 18", and a decorative light transmissive panel 20. Located on the light transmissive panel 20 are attachment or suspension means 22, adapted such that the device 10 may be attached to or suspended from a suspension point on a branch of a Christmas tree or other supporting object.

In accordance with an advantageous feature of the invention, the light transmissive panel can be disconnected from the holder portion to allow replacement by a different light transmissive panel.

In its preferred form, the light transmissive panel 20' comprises a lenticular card contained within a suitable frame 42. As before, a layer of light diffuser material (not shown) may be applied to the backside of the lenticular card to enhance the backlighting effect. The bottom rear portion of the frame 42 includes a slot 44 configured for receivingly engaging a tongue member 46 provided to the forward end of the holder portion 12. The sliding engagement is indicated by directional arrow D. The tongue member 46 may further include an end wall or stop member 48 to provide an abutment to the free sliding engagement between the slot 44 and tongue member 46.

In this embodiment, the focal reflective surface 18" is a dish shaped reflector configured as a truncated polyhedral angle, with a truncated tetrahedronal angle being preferred. The dish shaped reflector 18" may be fixedly or removably secured to the reflective surface support 16'.

Figure 9:
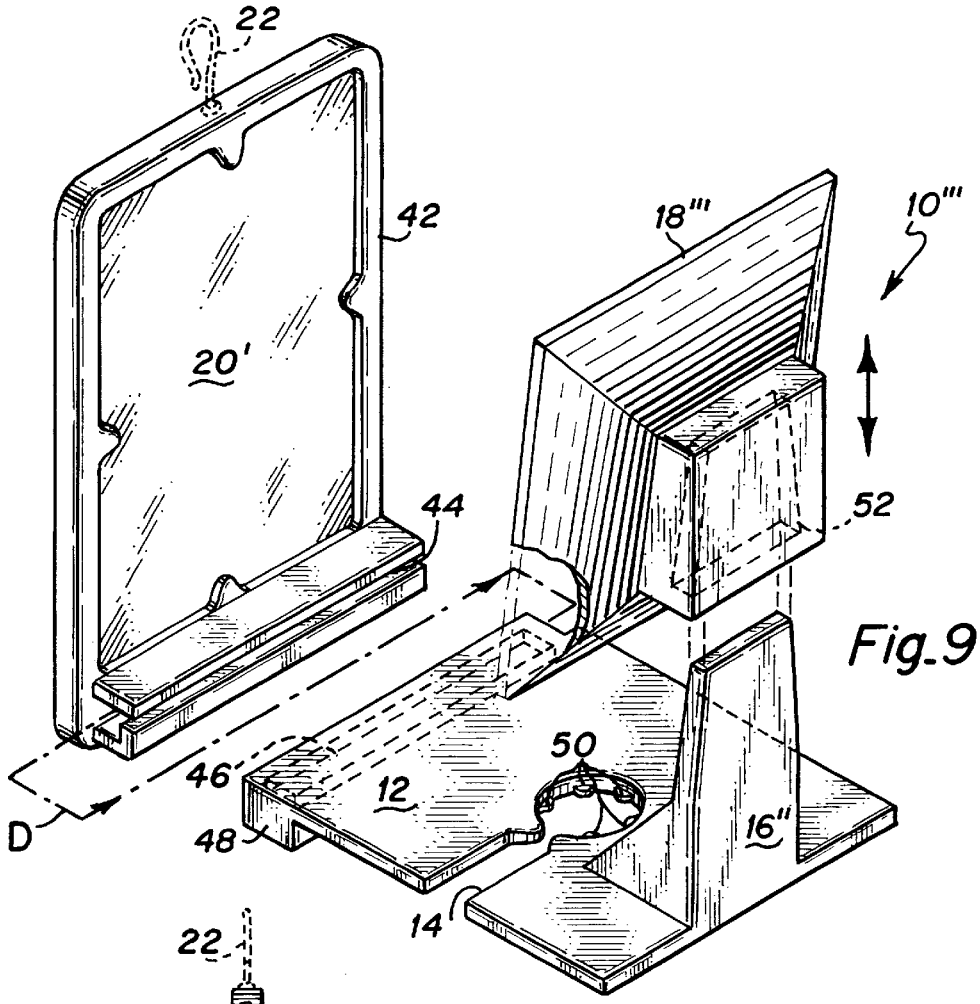
FIG. 9 is an exploded left rear isometric view of a third alternate embodiment of the backlighting apparatus of the present invention.
Figure 10:
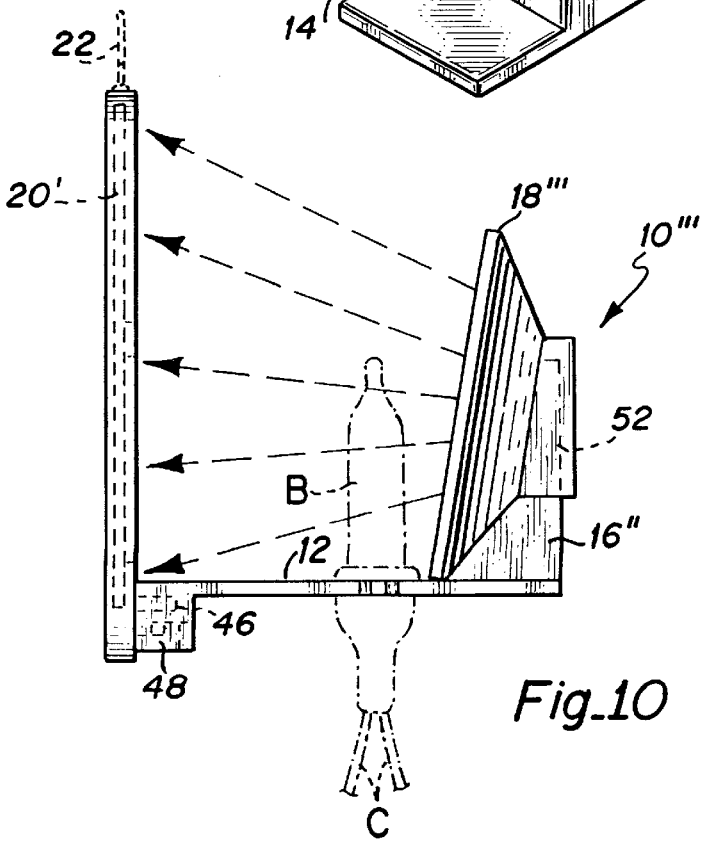
FIG. 10 is a left side elevation view of the third alternate embodiment of FIG. 9.

In FIGS. 9–10, there is shown a third alternate embodiment of the present invention generally designated by reference numeral 10'". This embodiment is substantially the same as the embodiment disclosed in FIGS. 7–8 except for the following additional features.

The light bulb retainer or slot 14 of the holder portion 12 is provided with nub means 50 or equivalent structure along an inner light bulb receiving surface thereof to provide a closed tolerance fit with the base or shaft portion of light bulbs having slightly different shaft diameters. Typically, the base or shaft portion for a light bulb of the common variety Christmas tree string of lights is formed of plastic material. As can be expected from any mass produced plastic part, tolerance discrepancies between individual piece do occur. The nubs 50 in the key hole slot 14 accommodate these tolerance discrepancies.

An additional feature of the invention is the disconnectable connection between the dish shaped reflector 18" and the holder portion 12. This feature advantageously allows for interchangability of different shaped reflectors as desired. As best seen in FIG. 9, the rear side of the dish shaped reflector 18" includes an upside down pocket or slot 52 which, in use, slidably engages, in swage fit fashion, the upstanding tongue-shaped reflector support 16".

Of course, it is understood that many variations and additional alternate embodiments are possible from the teachings described above by merely substituting, adding to and/or removing from various elements disclosed in the embodiments described in FIGS. 1–5 and FIGS. 6–10, respectively. For example, the embodiments shown and described in FIGS. 1–5 could be modified to include the diffusing means 23 of FIG. 6. It is also understood that the decorative panels 20 and 20' need not be rectangular as shown but could also comprise panels having irregular borders, such as borders that follow the profile of the decorative pattern or patterns printed or otherwise imaged thereon.

It should be noted at this time that the light being propagated by the bulb B in the contemplated practice of both embodiments of the invention is isotropic: I.e., that it is of equal intensity in all directions not blocked by its base. This is the standard type of low-wattage decorative bulb available, and the present invention is uniquely suitable to enhance their decorative effect.

It is apparent from the above that the present invention accomplishes all of the objectives set forth by providing a new and improved backlighting apparatus for a decorative ornament that will allow the user to easily attach and detach the lighted item from a Christmas tree or like object, and that will enhance a home or place of business.

With respect to the above description, it should be realized that the optimum dimensional relationships for the parts of the invention, to include variations in size, materials, shape, form, function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. An illuminated ornament backlighting apparatus adapted for connection in a string of light sockets used for decorating a tree or house, said illuminated ornament backlighting apparatus comprising:

a) a holder member having a front end portion, a rear end portion spaced from said front end portion, and light string engagement means disposed medial of said front and rear end portions, said light string engagement means adapted for releasable engagement of an existing string of decorative lights proximate at least one light bulb carried on the string;

b) a light transmissive ornament connected to said front end portion of said holder member; and c) a light reflecting surface connected to said rear end portion of said holder member, said light reflecting surface being oriented to reflect and direct light propagated from an engaged light bulb onto said light transmissive ornament to provide a desired backlighting effect for said light transmissive ornament.

2. The illuminated ornament backlighting apparatus according to claim 1, wherein said light reflecting surface comprises a dish shaped reflector configured as a truncated polyhedral angle.

3. The illuminated ornament backlighting apparatus according to claim 1, which further includes means for removably connecting said light reflecting surface to said rear end portion of said holder member.

4. The illuminated ornament backlighting apparatus according to claim 1, wherein said light string engagement means comprises a keyhole slot.

5. The illuminated ornament backlighting apparatus according to claim 4, wherein said keyhole slot includes nub engagement means for accommodating light bulb diameters with tolerance variations falling within a prescribed range.

6. The illuminated ornament backlighting apparatus according to claim 1, wherein said light transmissive ornament comprises a lenticular card.

7. The illuminated ornament backlighting apparatus according to claim 6, wherein said lenticular card includes a layer of light diffuser material applied to one side thereof.

8. The illuminated ornament backlighting apparatus according to claim 1, which further includes means for removably connecting said light transmissive ornament to said front end portion of said holder member.

9. The illuminated ornament backlighting apparatus according to claim 1, which further includes suspension means for suspending said illuminated ornament backlighting apparatus from a suspension point on a branch of a tree or other supporting object.

10. An illuminated ornament backlighting apparatus adapted for connection in a string of light sockets used for decorating a tree or house, said illuminated ornament backlighting apparatus comprising:

a) a holder member having a front end portion, a rear end portion spaced from said front end portion, and a light bulb retainer disposed medial of said front and rear end portions, said light bulb retainer adapted for releasable engagement of an existing string of decorative lights proximate at least one light bulb carried on the string;

b) a light transmissive ornament connected to said front end portion of said holder member; and c) a light reflecting surface connected to said rear end portion of said holder member, said light reflecting surface being oriented to reflect and direct light propagated from an engaged light bulb onto said light transmissive ornament to provide a desired backlighting effect for said light transmissive ornament.

11. The illuminated ornament backlighting apparatus according to claim 10, wherein said light reflecting surface comprises a dish shaped reflector configured as a truncated polyhedral angle.

12. The illuminated ornament backlighting apparatus according to claim 11, wherein said truncated polyhedral angle is a truncated tetrahedronal angle.

13. The illuminated ornament backlighting apparatus according to claim 10, wherein said light reflecting surface is removably connected to said rear end portion of said holder member.

14. The illuminated ornament backlighting apparatus according to claim 10, wherein said light bulb retainer comprises a keyhole slot.

15. The illuminated ornament backlighting apparatus according to claim 14, wherein said keyhole slot includes a plurality of nubs formed along an inner bulb receiving surface thereof for accommodating light bulb diameters with tolerance variations falling within a prescribed range.

16. The illuminated ornament backlighting apparatus according to claim 10, wherein said light transmissive ornament comprises a lenticular card.

17. The illuminated ornament backlighting apparatus according to claim 16, wherein said lenticular card includes a layer of light diffuser material applied to one side thereof.

18. The illuminated ornament backlighting apparatus according to claim 10, wherein said light transmissive ornament is removably connected to said front end portion of said holder member.

19. The illuminated ornament backlighting apparatus according to claim 10, which further includes a suspension member for suspending said illuminated ornament backlighting apparatus from a suspension point on a branch of a tree or other supporting object.

* * * * *